US005282293A

United States Patent [19]

Pedoeem

[11] Patent Number: 5,282,293

[45] Date of Patent: Feb. 1, 1994

[54] 180 DEGREE CONCEALED HINGE

[75] Inventor: Albert Pedoeem, West Orange, N.J.

[73] Assignee: AT&T Bell Laboratories, Murray Hill, N.J.

[21] Appl. No.: 891,103

[22] Filed: Jun. 1, 1992

[51] Int. Cl.[5] ..... E05C 17/64; E05D 11/06; E05D 3/06

[52] U.S. Cl. ..... 16/342; 16/371; 16/366

[58] Field of Search ..... 16/342, 366, 371, 379

[56] References Cited

U.S. PATENT DOCUMENTS

| | | | |
|---|---|---|---|
| 845,863 | 3/1907 | Erickson | 16/278 |
| 3,619,853 | 11/1971 | Merrill | 16/366 |
| 4,242,773 | 1/1981 | Beigh | 16/371 |
| 4,704,970 | 11/1987 | Sanderson et al. . | |
| 4,928,350 | 5/1990 | Morgan | 16/371 |
| 4,964,193 | 10/1990 | Rommelfaenger et al. | 16/342 |
| 5,158,503 | 10/1992 | Mitchell | 16/366 |

OTHER PUBLICATIONS

Undated catalog EMKA, Inc., 6332 Flank Drive, P.O. Box 6198, Harrisburg, Pa. "180° Concealed Hinge" pp. C060, C070.

*Primary Examiner*—John Sipos
*Assistant Examiner*—Carmine Cuda
*Attorney, Agent, or Firm*—Thomas Stafford

[57] ABSTRACT

A 180° concealed hinge includes two pivots which are advantageously arranged to provide a deterministic opening sequence. The hinge comprises a frame leaf member and a door leaf member which are pivotally connected to a mounting leaf member. In one embodiment of the invention, the deterministic opening sequence is obtained by employing a loose fit pivot and a friction fit pivot. The deterministic opening sequence is such that rotation occurs first about the loose fit pivot from a closed position to an approximately 90° open position when an opening rotational force is applied to the door leaf member. Upon reaching the 90° open position, further rotation about the loose fit pivot is prevented by a unique stop arrangement. Then, rotation can occur about the friction fit pivot for an additional 90°. Further rotation about the friction fit pivot is prevented by also employing another unique stop arrangement. Consequently, a door attached to the hinge is restricted to opening in a deterministic sequence to 180° in total.

3 Claims, 5 Drawing Sheets

180 DEGREE CONCEALED HINGE

TECHNICAL FIELD

This invention relates to a hinge arrangement and, more particularly, to a two-pivot 180° hinge arrangement which is concealed from the exterior of a cabinet.

BACKGROUND OF THE INVENTION

So-called 180° two-pivot concealed hinge arrangements are known in the art. In using a prior known two-pivot hinge arrangement, a problem arises because of the possible opening sequence of the hinge. Because the hinge may rotate about either of the two pivots, a situation can arise when an attached cabinet door is opened to 90°, in which the door could block equipment units inside the cabinet. That is to say, the door, when opened, would be in a position such that equipment units located at the extreme right side or left side of the cabinet would be blocked and could not be easily removed from the cabinet. Another problem with the prior hinge arrangement is that the door is allowed to rotate about the pivots such that adjacent cabinet doors, cabinet surfaces or the like could be damaged. Obviously, this would be highly undesirable.

SUMMARY OF THE INVENTION

The problems and limitations of the prior known hinge arrangements are overcome, in accordance with the principles of the invention, by employing a unique two-pivot hinge arrangement which is restricted to a deterministic opening sequence. The deterministic opening sequence of the hinge is realized, in accordance with the invention, by advantageously arranging the interconnections of the hinge members forming the two pivots such as to allow free rotation about a first one of the pivots prior to any rotation about a second one of the pivots.

In one embodiment of the invention, the deterministic opening sequence of the hinge is obtained by employing a unique two-pivot arrangement in which a predetermined one of the pivots is friction fit and the other pivot is loosely fit. More specifically, the deterministic opening sequence is such that rotation occurs first about the loose fit pivot from 0 to approximately 90° prior to any rotation about the friction fit pivot. Upon rotation about the loose fit pivot reaching 90°, further rotation about it is prohibited by employing a unique stop arrangement. Once rotation about the loose fit pivot has reached 90°, then rotation can occur about the friction fit pivot for an additional 90°. Again, further rotation about the friction fit pivot is prohibited by also employing a unique stop arrangement. Thus, by employing this unique invention, a door attached to the hinge is restricted to opening in deterministic sequence to 180° in total.

A technical advantage of this unique invention is that the opening sequence ensures that no equipment units are blocked at the 90° opening position and that adjacent cabinet surfaces, doors and the like, are not damaged.

DETAILED DESCRIPTION

Figure 1:
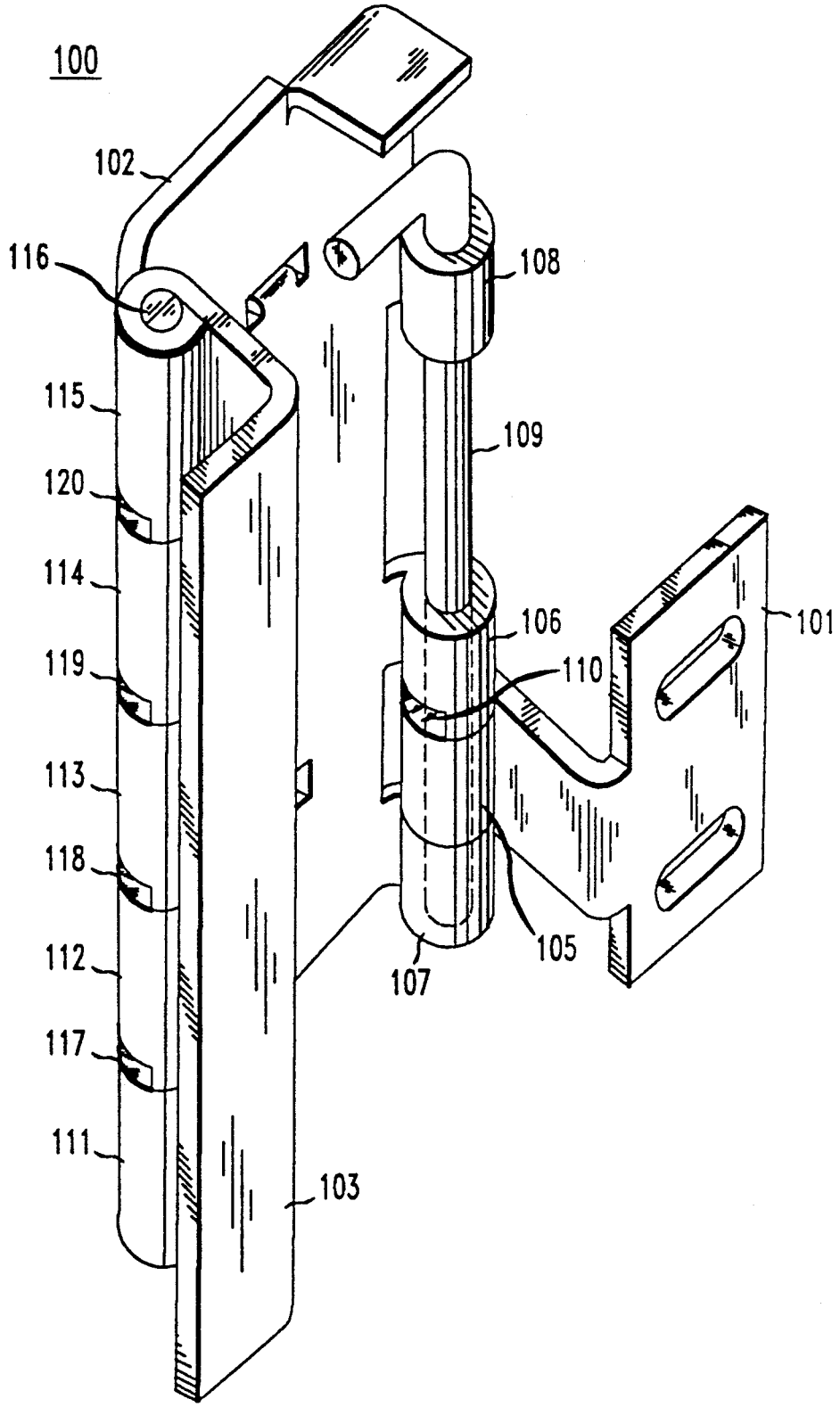
FIG. 1 shows a perspective view of a hinge arrangement including an embodiment of the invention in a closed position.

FIG. 1 is a perspective view of a so-called left hand hinge arrangement 100 employing the invention, the hinge arrangement being in a fully closed position. Specifically shown are frame leaf member 101, mounting leaf member 102 and door leaf member 103. Frame leaf member 101 includes knuckle element 105, while mounting leaf member 102 includes a plurality of knuckles 106, 107 and 108. Knuckles 105 through 108 form a sleeve element which is employed in conjunction with pin member 109 to form a first pivot. In particular, pin member 109 is interconnects frame leaf member 101 and mounting leaf member 102 via the sleeve formed by knuckles 105 through 108. In this embodiment of the invention, it should be noted that the dimensions of the diameter of pin member 109 and the diameter of holes formed in knuckles 105 through 108 are such to allow a fit which is sufficiently loose as to allow frame leaf member 101 to freely rotate about pin member 109, i.e., the first pivot. In a specific embodiment of the invention, a difference of approximately 0.010 to 0.015 inches between the diameter of pin member 109 and the holes in knuckles 105 through 108 has been found to allow a sufficiently loose fit, in accordance with the invention. It should also be noted that pin member 109 is easily removable from knuckle 105 so that frame leaf member 101 can be easily removed from mounting leaf member 102. A spring arrangement and a snap-on retainer (not shown) would typically be employed between knuckles 106 and 108 to ensure that pin member 109 cannot be fully removed from knuckles 106 and 108. Also included in the loose fit first pivot arrangement is a unique stop arrangement that prohibits the rotation of frame leaf member 101 beyond approximately 90° from the closed position. This stop could be realized in a number of ways. In this particular embodiment of the invention, knuckles 106 and 107 are stepped or notched at 110 in such a fashion to allow the 90° rotation and prohibit further rotation.

Door leaf member 103 includes knuckles 111, 113 and 115, and is arranged to support an associated cabinet door. Similarly, mounting leaf member 102 includes knuckles 112 and 114. Knuckles 111, 112, 113, 114 and 115 form a sleeve which is employed with pin member 116 to form the second pivot. Pin 116 is used to interconnect mounting leaf member 102 and door leaf member 103 via the sleeve formed by knuckles 111 through 115. This second pivot is arranged to have a friction fit, i.e., a relatively tight fit, in accordance with the principles of the invention, which provides sufficient resistance to opening that frame leaf member 101 will open to its 90° position about the first pivot prior to any rotation of door leaf member 103 about pin member 116 of the second pivot. The desired friction fit can be obtained in any number of ways. One such way is to either make the diameter of pin member 116 sufficiently large to provide a desired degree of resistance to rotation. Alternatively, the diameter of the holes in knuckles 111 through 115 can be made sufficiently small to provide the desired friction fit. Another approach to providing the friction fit would be to use an abrasive surface on pin member 116 or internal to knuckles 111 through 115. It will be apparent that the relative friction of this friction fit pivot is dependent on the relative looseness of the above-described loose fit pivot. Also included in the friction fit pivot arrangement is a unique stop arrangement that prohibits the rotation of door leaf member 103 beyond an approximately 90° from the closed position. This could be realized in a number of ways. In this particular embodiment of the invention, adjacent ones of knuckles 111 through 115 are stepped or notched at 117 through 120 in such a fashion to allow the approximately 90° rotation and prohibit further rotation. Note that frame leaf member 101 and door leaf member 103 are L-shaped and are oriented so that mounting leaf member is positioned in front of hinge 100. Further, the L-shaped frame leaf member 101 and door leaf member 103 also facilitate the 90° rotation about each of the pivots.

Figure 2:
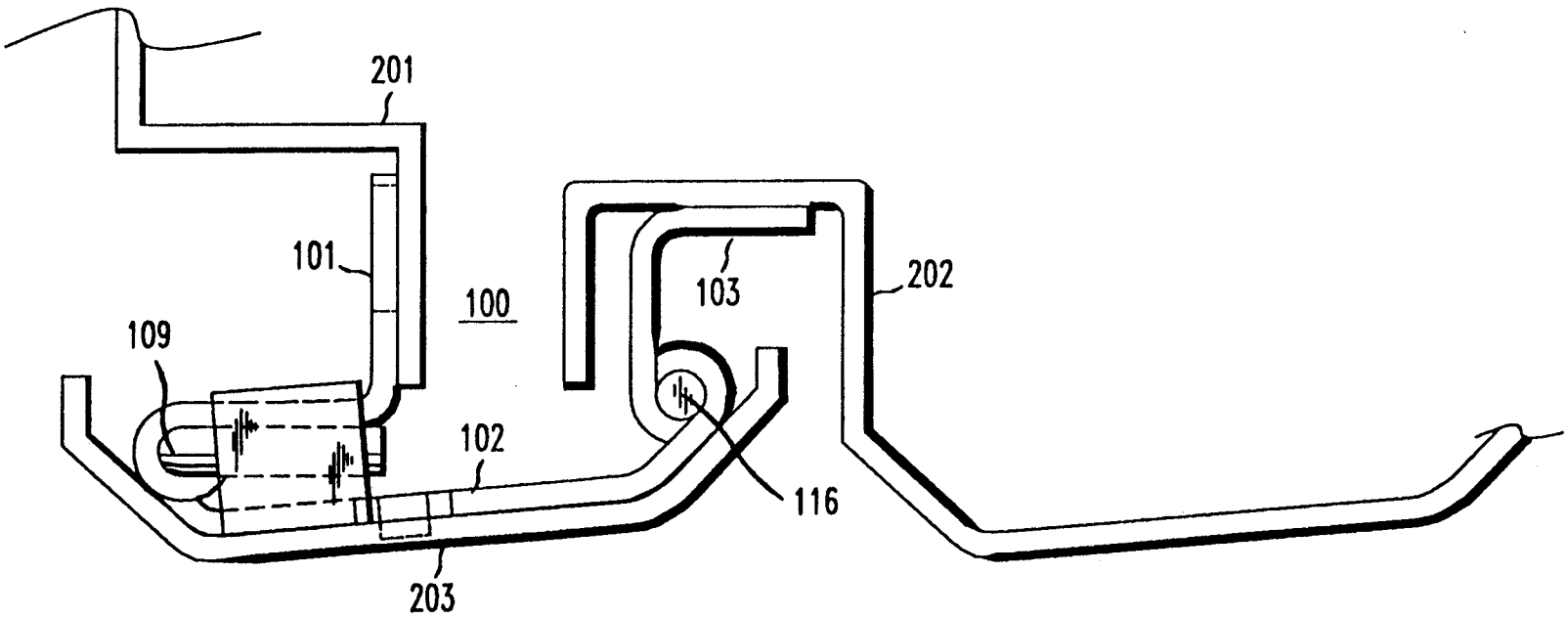
FIG. 2 shows a top view of the hinge of FIG. 1 in the closed position when assembled to a door.

FIG. 2 shows a top view of hinge arrangement 100 in a fully closed position. Elements that are the same as shown in FIG. 1 are similarly numbered and provide the functionality as described above regarding FIG. 1. Specifically, shown are frame leaf member 101 connected to frame 201, door leaf member 103 connected to cabinet door 202 and mounting leaf member 102 has style strip 203 mounted on its front surface. In this connection, it is noted that mounting leaf member 102 is advantageously positioned, in accordance with an aspect of the invention, so that it is facing the front of the cabinet. Style strip 203 is has an outward appearance that is similar to cabinet door 202 and effectively conceals the hinge from being viewed from the front of the cabinet. Also shown are pin 109 connecting frame leaf member 101 to mounting leaf member 102 and pin member 116 connecting door leaf member 103 to mounting leaf member 102.

Figure 3:
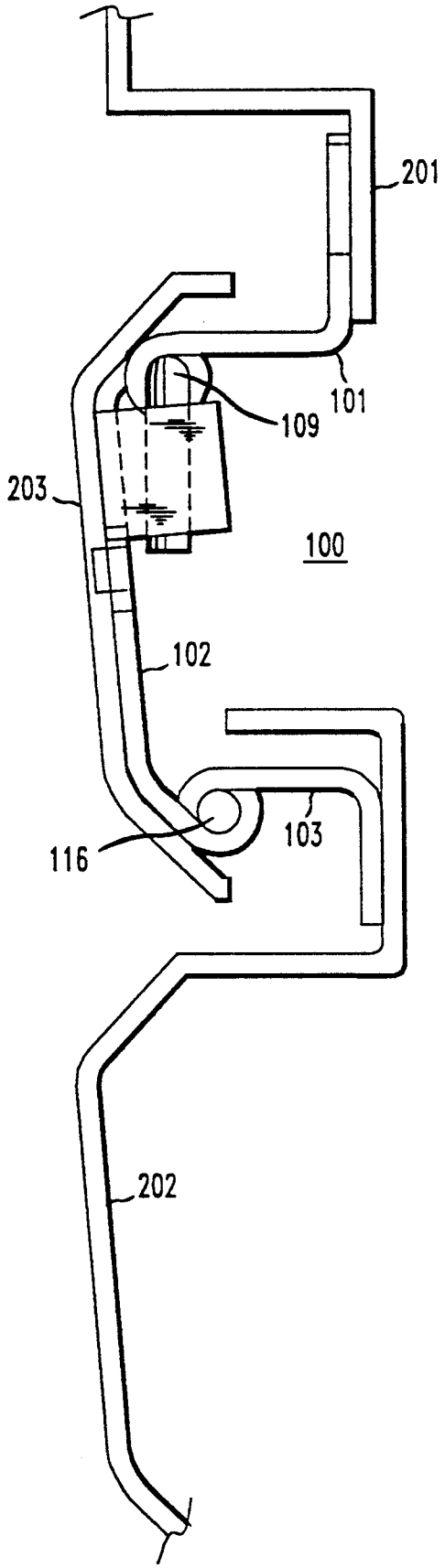
FIG. 3 shows another top view of the hinge arrangement in a 90° partially open position.

FIG. 3 shows another top view of hinge arrangement 100 being opened to a first position in the deterministic opening sequence, namely, rotating to a 90° position about the loose fit pivot formed by pin 109 and the knuckle members of both frame leaf member 101 and mounting leaf member 102. Again, as indicated above, the unique use in accordance with the principles of the invention, of the loose fit pivot allowing free rotation about pin 109 and the use of a friction fit pivot about pin 116, formed by the knuckles of door leaf member 103 and mounting leaf member 102, ensures the deterministic opening sequence in which there is no initial rotation about pin 116 until the 90° rotation about pin 109 has been realized. In this 90° open position, cabinet door 202 and style strip 203 are readily removable from frame 201 by lifting pin 109.

Figure 4:
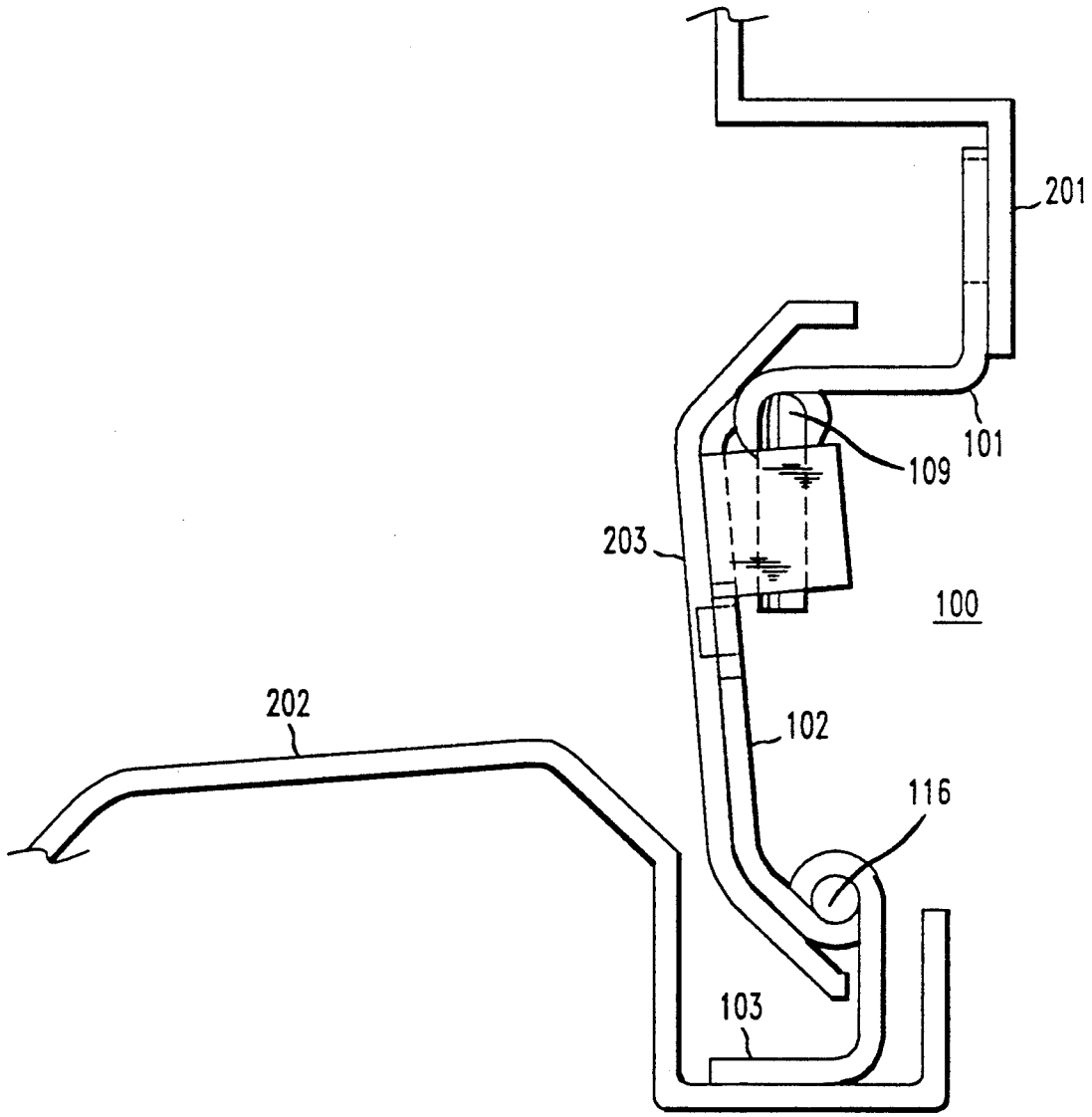
FIG. 4 shows another top view of the hinge arrangement in a 180° fully open position.

FIG. 4 shows another top view of hinge arrangement 100 in the fully opened 180° position. Again, and in accordance with the principles of the invention, free rotation is first allowed about pin 109 until the 90° position is reached and further rotation is prohibited by employing unique stop 110. Stop 110 prohibits further rotation of mounting leaf member 102 about pin 109 and, thereby, allows rotation of door leaf member 103 about the friction fit pivot formed by knuckles 111 through 115 and pin 116. Rotation is allowed about pin 116 until the fully open 180° position is reached. Further rotation of door 202 and door leaf member 103 about pin 116 is also prohibited by using a unique stop arrangement. In this embodiment, stops 117 through 120 are employed for this purpose. It should be noted that the stops incorporated in the hinge pivots prevent door 202 from damaging style strip 203, any adjacent cabinet door surfaces or itself.

Figure 5:
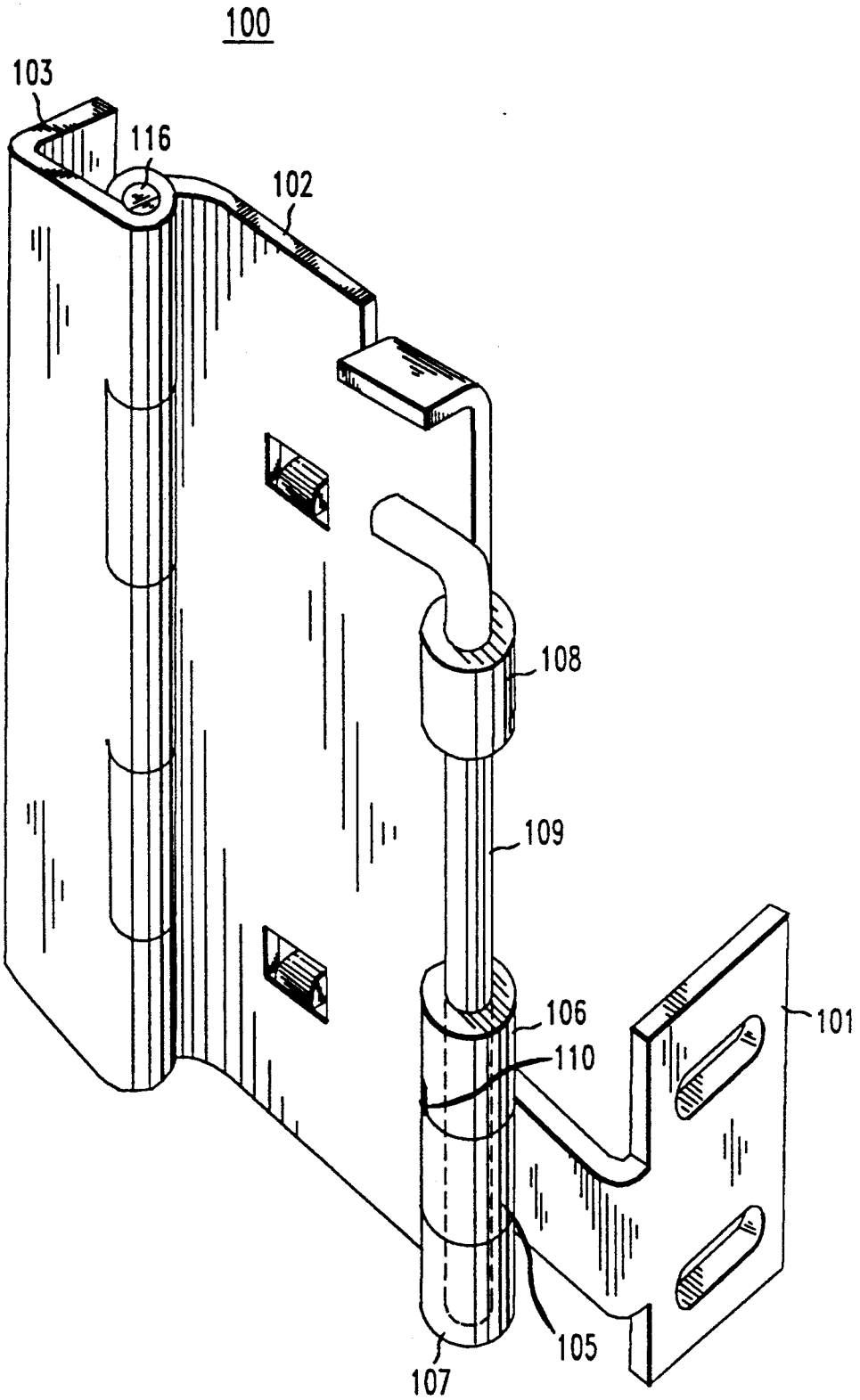
FIG. 5 shows a perspective view of the hinge arrangement in the 180° fully open position.

FIG. 5 shows a perspective of hinge arrangement 100 in a 180° fully open position. Again, the elements of hinge 100 shown in FIG. 5 have been similarly numbered to those shown and described above and will not be further described in detail here.

It will be apparent that a right hand hinge arrangement would have an opposite orientation of the elements from the described left hand hinge arrangement.

The above-described arrangement is, of course, merely illustrative of the application of the principles of the invention. Other arrangements may be devised by those skilled in the art without departing from the spirit or scope of the invention.

I claim:

1. A 180° two pivot concealed hinge, comprising:

a frame leaf member including a first edge and a second edge, one of said edges having a plurality of knuckles thereon;

a mounting leaf member including a first edge and a second edge, each of said edges having a plurality of knuckles thereon; and a door leaf member including a first edge and a second edge, one of said edges having a plurality of knuckles thereon, said frame leaf member and said mounting leaf member being interconnected about a first pivot formed by the knuckles on the edge of said frame leaf member and the knuckles on one edge of said mounting leaf member, said door leaf member and said mounting leaf member being interconnected about a second pivot formed by the knuckles on the edge of said door leaf member and the knuckles on the other edge of said mounting leaf member, wherein said frame leaf member is L-shaped extending rearwardly from said mounting leaf member in a fully closed hinge position and having one leg which is adapted to be mounted to a cabinet frame and said knuckles forming a part of said first pivot being at the edge of another leg, said door leaf member is L-shaped extending rearwardly from said mounting leaf member in a fully closed hinge position and having a leg which is adapted to have a door structure attached thereto and said knuckles forming a part of said second pivot being at the edge of another leg, and said mounting leaf member has said knuckles forming part of said first pivot at a first edge and said knuckles forming a part of said second pivot at a second edge and extends between said pivots, said frame leaf member, and said door leaf member are substantially wholly positioned between said pivots when the hinge is fully closed so that said mounting leaf member being positioned in front of and covers said frame leaf, and wherein the interconnection of said frame leaf member and said mounting leaf member forming said first pivot is a loose fit and the interconnection of said door leaf member and said mounting leaf member forming said second pivot is a friction fit and are such as to allow free rotation about said first pivot to an approximately 90° position prior to any rotation about said second pivot when an opening rotational force is applied to said door leaf member, said first pivot including a first stop structure which limits the rotation to the approximately 90° position and upon further applying the opening rotational force to said door leaf member allows rotation about said second pivot to an approximately 180° position, said second pivot including a second stop structure which prevents rotation about said second pivot beyond said approximately 180° position.

2. The invention as defined in claim 1 wherein said knuckles on said edge of said frame leaf member and said knuckles on the one edge of said mounting leaf member form a first sleeve structure and said said knuckles on said edge of said door leaf member and said said knuckles on the other edge of said mounting leaf member form a second sleeve structure, and further including a first pin member which in conjunction with said first sleeve structure forms said first pivot and a second pin member which in conjunction with said second sleeve structure forms said second pivot, wherein a hole in said first sleeve structure and said first pin member have diameters such that said first sleeve structure provides said loose fit about said first pin so that said mounting leaf member may freely rotate about said first pivot and wherein a hole in said second sleeve structure and said second pin have diameters such that said second sleeve provides said friction fit about said second pin so that there is a prescribed resistance to rotation of said door leaf member and said mounting leaf member about said second pivot.

3. The invention as defined in claim 2 wherein said mounting leaf member is adapted so that a style strip is mountable on a front surface thereof.

* * * * *